United States Patent [19]

de la Fonteijne

[11] Patent Number: 4,861,977

[45] Date of Patent: Aug. 29, 1989

[54] ELONGATED X-RAY DETECTOR TUBE

[75] Inventor: Marcel R. de la Fonteijne, Delft, Netherlands

[73] Assignee: B.V. Optische Industrie 'De Oude Delft', Delft, Netherlands

[21] Appl. No.: 153,250

[22] Filed: Feb. 8, 1988

[30] Foreign Application Priority Data

Feb. 13, 1987 [NL] Netherlands ..... 8700359

[51] Int. Cl.[4] ..... H01J 40/14

[52] U.S. Cl. ..... 250/213 VT; 313/526

[58] Field of Search ..... 250/213 R, 213 VT; 313/526

[56] References Cited

U.S. PATENT DOCUMENTS 3,894,258 7/1975 Butterwick ..... 313/526

4,178,528 12/1979 Kennedy ..... 313/526

4,254,437 3/1981 Funk et al. ..... 250/213 R

*Primary Examiner*—David C. Nelms

*Assistant Examiner*—Stephone B. Allen

*Attorney, Agent, or Firm*—Louis E. Marn

[57] ABSTRACT

The housing of an elongated proximity-focus image intensifier comprises at least two elongated parts. The parts have in cross-section such dimensions and such a configuration that the housing is self-supporting. An exemplary embodiment of such a housing which is essentially rectangular in cross-section has a front wall, a rear wall and two side walls, all having an essentially rectangular cross-section. In the case of at least two pairs of adjacent walls the edge in the longitudinal direction of the surface, facing the interior of the housing, of a first of the pair of walls is provided with profiling in the form of a recessed section in which the longitudinal edge of the adjacent tube wall is received.

20 Claims, 1 Drawing Sheet

ELONGATED X-RAY DETECTOR TUBE

The invention relates to an x-ray detector tube comprising an elongated housing constructed from at least two elongated parts which together define the cross-section of the housing, in which housing an elongated proximity-focus image intensifier device is provided and in which housing a vacuum prevails.

Such an x-ray detector tube having one cathode and one anode is described in the Dutch Patent Application No. 8500709. Such detector tubes have the advantage that, as a result of the elongated form thereof, they are, inter alia, very suitable for use in tomography or in radiography with slit scanning, it being possible for a strip-like x-ray image to be formed on the anode of the detector tube by means of a narrow x-ray beam. Since the x-ray image is strip-like, the use of an elongated anode is appreciably more advantageous than the use of a conventional circular anode. To detect the x-ray image, the anode is provided with a layer of phosphor in which those phosphor particles which are struck by electrons emitted by the associated cathode fluoresce, which electrons are emitted by the cathode in response to the x-rays striking the cathode.

In this known x-ray detector tube and in all other known elongated x-ray detector tubes, the length of the tube cannot exceed a predetermined dimension because the total strength of the tube, i.e. the resistance to deformation thereof, is determined, inter alia, by the end walls of the tube present at the ends of the elongated housing, which end walls often, but not necessarily, form part of one of the at least two housing parts. A low deformation of the housing of an x-ray tube is of supreme importance to prevent the vacuum-tight joints between the at least two housing parts deforming and, as a result thereof, possibly being able to give rise to leakage, which makes the tube unusable.

The object of the invention is to provide an x-ray tube in which the maximum length can be freely chosen. For this purpose, the invention provides an x-ray tube of the above-mentioned type in which the at least two housing parts each have in cross-section such dimensions and such a configuration that the housing is self-supporting for any length whatsoever thereof.

The invention is based on the insight that, if the housing parts in the case of an x-ray detector tube define a housing with a cross-sectional area which is at all events appreciably smaller than that of the known housings, constructed from at least two parts, for x-ray detector tubes, such a housing is capable of having an appreciably lower weight than the known tubes and as a result thereof, can in principle be self-supporting because the deformation as a result of the intrinsic weight of the tube is then small. If, in addition, the housing parts then have such a configuration in cross-section that the connecting surfaces between said parts are only under pressure load as a result of the forces exerted on the walls by the environment if a vacuum prevails in the interior of the housing, leakage is eliminated. Such a pressure loading is, after all, the type of loading that the vacuum-tight joints between the housing parts are able to absorb very well. As a result of the combination of a tube having a low weight and connecting surfaces which are exclusively under pressure loading, a housing is therefore obtained which is self-supporting and cannot leak.

According to a preferred embodiment, the invention relates to an x-ray detector tube comprising a housing which is essentially rectangular in cross-section, the housing parts comprising a front wall, a rear wall with an essentially rectangular cross-section and two side walls, the front wall and the side walls also having an essentially rectangular cross-section and, in the case of at least two pairs of adjacent walls, the edge in the longitudinal direction of the surface, facing the interior of the housing, of a first of the pair of walls being provided with a profiling in the form of a recessed section in which the longitudinal edge of the adjacent wall is received.

In the case of the x-ray detector tube known from the Dutch Patent Application No. 8500709, the rear wall of the tube has such a configuration that it has an appreciably greater resistance to deformation than the side walls of the tube. As the same time, in the front wall of the tube an x-ray transmitting window, for example, a window composed of thin stainless steel is provided and, at the end of the side walls facing the rear wall, a metal flange is welded onto which the rear wall is fitted in a vacuum-tight manner. The high resistance of the rear wall to deformation prevents the side walls of the tube deforming during and after the evacuation of the housing because the rear wall supports the side walls against sagging over a part of the height thereof.

According to the preferred embodiment of the invention, the known x-ray detector tube is improved in that it has a still greater resistance to sagging than the known tube and nevertheless has a lower weight, while it is possible for the tube also to consist of a minimum number of components, which affects the cost price beneficially.

The invention will be explained in more detail below on the basis of exemplary embodiments with reference to the drawing, in which.

Figure 1:
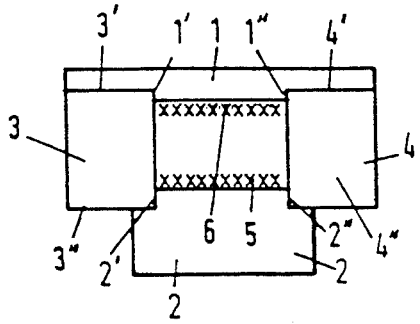
FIG. 1 shows a view in section of a first embodiment of an x-ray detector tube according to the invention.

FIG. 1 shows an x-ray detector tube according to the invention, the housing of which has a front wall 1, a rear wall 2 and side walls 3 and 4. As FIG. 1 shows, the front and rear walls 1 and 2 respectively are provided with a profiling along the longitudinal edges thereof in the form of a recessed section in which the adjacent longitudinal edges of the side walls 3 and 4 are at least partially situated.

Figure 2:
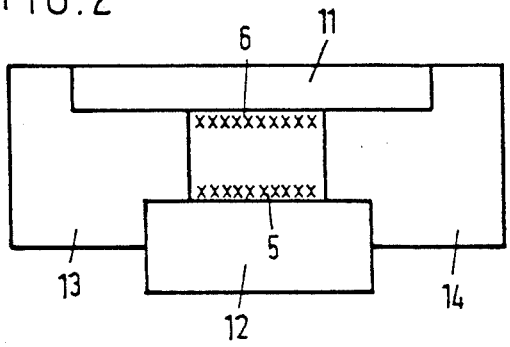
FIG. 2 shows a view in section of a second embodiment.

FIG. 2 shows a second embodiment of the x-ray detector tube, the housing of which has a front wall 11, a rear wall 12 and side walls 13 and 14. The difference from the embodiment according to FIG. 1 is that the longitudinal edges of the side walls are now provided with a profiling in the form of a recessed section in which the adjacent longitudinal edges of the front wall 11 and the rear wall 12 are at least partially situated. It is obviously also possible to produce a housing in which the rear wall is provided in the manner shown in FIG. 1 and the front wall in the manner shown in FIG. 2 or even a housing in which the rear wall is provided in the manner shown in FIG. 2 and the front wall in the manner shown in FIG. 1.

The x-ray detector tube according to the invention has, as a result of the chosen size and configuration of the housing walls, sufficient strength per se that the housing thereof is self-supporting and the length of the housing can essentially be completely freely chosen, this being in contrast to the existing tube housings in which the end faces provided at the longitudinal ends of the housing provide a part of the required strength. which means that the maximum tube length is in that case fixed beforehand.

An important point in the embodiments according to FIGS. 1 and 2 and of the variance thereof is that the forces which are exerted on the walls of the housing from outside subject the joints between the walls exclusively to pressure load as a consequence of the vacuum prevailing in the interior of the housing.

Thus, for example, in FIG. 1 the front wall 1 is forced against the edges 3' and 4' of the side walls 3 and 4 and the side walls 3 and 4 respectively are forced against the edges 1' and 1" of the front wall. In an identical manner, the rear wall 2 is forced against the edges 3" and 4" of the side walls and the side walls 3 and 4 respectively are forced against the edges 2' and 2" of the rear wall. The same applies, mutatis mutandis, for the embodiment according to FIG. 2.

The advantage of this construction is that the risk of leakage of the various vacuum joints between the walls is minimal. The usual materials for joining the tube walls to each other in a vacuum-tight manner are frit and solder, and the joints achieved with such a material between the various adjacent edges of the housing walls have much better resistance to pressure loading than tension loading.

In the case of x-ray detector tubes according to FIGS. 1 and 2, the side walls are produced from glass or from a ceramic material. The front wall may be produced from glass or aluminium or another material transparent to x-rays and the rear wall from a light-transparent material such as glass or glass-fibre plate. To prevent the tube sagging in the longitudinal direction as a result of its intrinsic weight, the side walls 3 and 4 have preferably a relatively large thickness.

In addition to the advantage of being self-supporting and of having a low risk of leakage, the tube according to the invention has the great advantage that, compared with the existing x-ray detector tubes, it has a low weight as a result of the low cross-sectional area thereof and because a very thick rear wall is not necessary. In the case of scanning in particular, where the tube has to be moved with respect to the patient under investigation, this offers advantages because the construction of the displacement mechanism for the tube can be lighter.

In the case of the x-ray detector tube according to the invention, it is obviously also possible to produce three adjacent walls, for example the front wall and two side walls from one entity, for example from a rectangular glass rod in which a groove is milled to form the interior of the housing.

The rear wall 2 or 12 composed of glass or glass fibre plate in the case of the embodiments of the x-ray detector tube according to FIGS. 1 and 2 forms the carrier for the anode phosphor 5 provided to the inside of said wall. The anode image can be viewed through the transparent rear wall. It is also possible to produce the rear wall from opaque material in which a window is provided for viewing the anode image.

Although it is possible to provide a cathode carrier on which an x-ray screen and a photocathode are provided, in a conventional manner in the x-ray detector tube according to FIGS. 1 and 2, the x-ray screen and the photocathode, which are indicated jointly by reference numeral 6 in the figure, are preferably provided directly against the inside of the front wall 1 and 11 respectively. This has the great advantage that a separate support does not have to be provided in the tube for the cathode carrier, while, as a result of the absence thereof, the cost price and the weight are also beneficially affected. The x-ray screen and the photocathode can be provided against the inside of the front wall 1 in a manner known per se to those skilled in the art.

To obtain a distortion-free imaging of the cathode image on the anode, it is necessary for the electric field between the cathode and anode to be homogeneous. The presence of the side walls of the tube has, however, a disadvatageous effect on this homogeneity. In known x-ray detector tubes this problem is eliminated by chosing effective dimensions of the anode and the cathode in the tube between the side walls which are appreciably smaller than the actual dimensions between the side walls. This has, however, the drawback that the dimensions of the tube are in fact unnecessarily large, which has in turn a disadvantageous effect on the weight, the cost price, the production yield and the risk of leakages. According to a preferred embodiment of the invention, the effective dimensions of the anode and the cathode between the side walls are essentially equal to the actual distance between the side walls. In order, nevertheless, to guarantee a homogeneous electric field between the anode and the cathode at the same time, the insides of the side walls are provided with a layer which is to some extent electrically conducting, for example, a layer of $Cr_2O_3$, through which layer an electric current flows during operation, the magnitude of which current is a few times, for example ten times, greater than the current which flows from the anode to the cathode. The potential gradient across the layer on the side walls which is to some extent conducting ensures that the presence of the side walls does not disturb the homogeneity of the electric field between anode and cathode.

Instead of evaporating a conducting layer onto the side walls, it is also possible to produce said walls themselves from a lead-containing glass whose surface facing the interior of the tube has been rendered conducting by reduction. It is also possible to provide, on the side walls, electrically conducting strips extending in the longitudinal direction of the tube, which strips have electrical connections to the outside of the tube. By connecting different electrical potentials to said strips it is possible to achieve the desired potential gradient.

Figure 3:
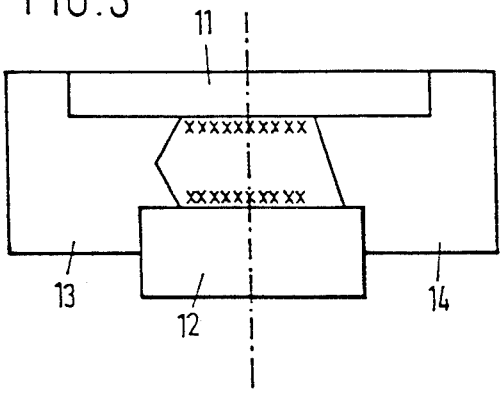
FIG. 3 shows a view in section of a third embodiment.

To prevent the side walls disturbing the image formation in the tube by secondary emission, the anode and the cathode are nevertheless preferably chosen somewhat narrower than the dimensions between the insides of the side walls. The effect of secondary emission can be reduced still further by giving the side walls the configuration shown in FIG. 3. In FIG. 3, the same reference numerals have been used as in FIG. 2, the said figure showing, at the left-hand side, a first possible configuration of the inside of the side wall and, at the right-hand side, a second possible configuration. Both the configurations shown in Figure 3 reduce the effect of the secondary emission and increase the path across the surface of the side wall between the anode and the cathode. In view of the large potential difference of a few kilovolts applied between anode and cathode, this last point may be desirable in order to increase the insulation path between anode and cathode.

As has already been remarked above, regardless of the materials used for the walls, the various walls of the tube may be joined by means of frit or solder. In this connection solder is preferable because the components joined by said material can be recovered, for example, if a manufactured tube proves to be defective. This is, in particular, of importance for the recovery of the expensive fibre plate.

By giving the front and/or rear wall a curvature, if desired, a magnification or reduction of the x-ray image can be obtained. The configurations shown in the figure obviously give a 1/1 imaging of the cathode image on the anode.

If the tube wall which carries the anode is produced from glass, the choice is preferably for as thick a glass plate as possible composed of non-absorbent glass. In the known x-ray detector tubes, the tube wall which carries the anode is produced from absorbent glass because the undesirable halo effect is suppressed by said absorbent glass. Use of absorbent glass has, however, the drawback that not only is the halo effect suppressed, but that the light intensity of the actual image is attenuated, which is obviously undesirable.

Due to the configuration of the x-ray detector tube according to the invention it is feasible to use a thick non-absorbent glass plate as carrier for the anode phosphor. In the known tubes this would lead to a much too high tube weight. By choosing, in the case of the tube according to the invention, a thickness for the rear wall approximately equal to the width thereof, the halo effect appears to be suppressed by approximately 90%, while, due to the use of non-absorbent glass, no signal attenuation occurs.

I claim:

1. An X-ray detector tube which comprises;

an elongated front wall;

an elongated rear wall;

elongated side walls for receiving said elongated front wall and elongated rear wall thereby forming an elongated housing and defining therebetween an elongated proximity-focus image intensifier device, at least two walls being configured to support walls of said housing along its length.

2. An X-ray detector tube according to claim 1 wherein said housing is essentially rectangular in cross-section and wherein said front wall and said side walls are essentially rectangular in cross-section, at least two pairs of adjacent walls an edge in a longitudinal direction of a surface facing an interior or said housing being provided with a profiling in the form of a recessed section to receive a longitudinal edge of an adjacent wall.

3. An X-ray detector tube according to claims 2 wherein longitudinal edges of said surface facing said interior of said housing of said front wall and said rear wall, respectively, are provided with profiling in the form of a recessed section.

4. An X-ray detector tube according to claim 2 wherein longitudinal edges of said surfaces facing said interior of said housing, of the side walls are provided with profiling in the form of a recessed section.

5. X-ray detector tube according to one of the claims 2–4, in which an anode phosphor is provided on the surface of the rear wall facing the interior of the housing, characterized in that the rear wall is produced from glass.

6. X-ray detector tube according to claim 2, characterized in that the front wall is produced from glass.

7. X-ray detector tube according to one of the claims 2–4, in which an anode phosphor is provided on the surface of the rear wall facing the interior of the housing, characterized in that the rear wall is produced from glass fibre plate.

8. X-ray detector tube according to claim 5, characterized in that the glass is a non-absorbent glass type and in that the thickness of the rear wall is of the size of the width thereof.

9. X-ray detector tube according to one of the claims 2–7, characterized in that the front wall is produced from aluminium.

10. X-ray detector tube according to claim 6 or 9, characterized in that an x-ray screen and a photocathode are provided on the surface of the front wall facing the interior of the housing.

11. X-ray detector tube according to one of the claims 2–10, characterized in that the side walls are produced from glass.

12. X-ray detector tube according to one of the claims 2–10, characterized in that the side walls are produced from ceramic.

13. X-ray detector tube according to claim 11, characterized in that the glass is a lead-containing glass type.

14. X-ray detector tube according to claim 11 or 12, characterized in that the surfaces of the side walls facing the interior of the housing are provided with electrically conducting elements.

15. X-ray detector tube according to claim 14, characterized in that the electrically conducting elements on each of the side walls consists of a number of electrically conducting strips extending in the longitudinal direction of the tube, electrical connections being provided for said strips outside the interior of the housing.

16. X-ray detector tube according to claim 14, characterized in that the electrically conducting elements consist of a continuous vapour deposited layer of material which is to some extent electrically conducting.

17. X-ray detector tube according to claim 16, characterized in that the material which is to some extent electrically conducting is $Cr_2O_3$.

18. X-ray detector tube according to one of the claims 13–17, characterized in that the width of the strip of anode phosphor on the rear wall is essentially equal to the distance between the interior surfaces of the side walls.

19. X-ray detector tube according to claim 18, characterized in that the distance between the interior surfaces of the side walls in the interior of the housing, viewed in cross-section, first increases, starting from the front wall, to a maximum distance at approximately half the distance between the front wall and the rear wall and then decreases again towards the rear wall to essentially the same distance as at the front wall.

20. X-ray detector tube according to claim 18, characterized in that the distance between the interior surfaces of the side walls in the interior of the housing, viewed in cross-section, gradually decreases towards the front wall starting from the rear wall.

* * * * *